US007424784B1

(12) United States Patent
Leahy

(10) Patent No.: US 7,424,784 B1
(45) Date of Patent: Sep. 16, 2008

(54) PRIVACY CALENDAR COVER

(76) Inventor: Laurie J. Leahy, 82 Acres Ave., West Yarmouth, MA (US) 02673

( * ) Notice: Subject to any disclaimer, the term of this patent is extended or adjusted under 35 U.S.C. 154(b) by 0 days.

(21) Appl. No.: 11/835,602

(22) Filed: Aug. 8, 2007

(51) Int. Cl.
*G09D 3/00* (2006.01)

(52) U.S. Cl. ..... 40/107; 40/658; 283/2

(58) Field of Classification Search ..... 40/107, 40/658, 574, 772; 283/2–4
See application file for complete search history.

(56) References Cited

U.S. PATENT DOCUMENTS 1,487,520 A * 3/1924 Ringler ..... 40/722
1,852,881 A * 4/1932 Gray ..... 283/3
2,003,142 A * 5/1935 Fisher ..... 40/107
2,017,268 A * 10/1935 Winford ..... 283/3
2,041,097 A * 5/1936 Vierling ..... 40/119
4,098,014 A * 7/1978 Lauer et al. ..... 40/1.5
4,282,668 A * 8/1981 Jolkovski ..... 40/790
4,458,433 A * 7/1984 Breeze ..... 40/107
4,852,282 A * 8/1989 Selman ..... 40/711
5,062,229 A * 11/1991 Werjefelt ..... 40/107
5,125,688 A * 6/1992 Bianco ..... 283/2
5,979,096 A * 11/1999 Ferdinandsen et al. ..... 40/768
6,324,777 B1 * 12/2001 Ngan ..... 40/107
7,093,857 B2 * 8/2006 Martin ..... 283/2
7,128,301 B2 * 10/2006 Shepard et al. ..... 248/447.1
7,261,269 B2 * 8/2007 Cote ..... 248/317
2001/0040423 A1 * 11/2001 Sheehan ..... 312/245

* cited by examiner

*Primary Examiner*—William L. Miller

(57) ABSTRACT

A privacy calendar cover that is constructed of a cover body formed of a top portion and a bottom portion joined together by a hinge member, a top portion is substantially transparent and the bottom portion is substantially opaque, and an elongated clip that has a U-shaped gap opening in a cross section which is substantially equal to a thickness of a calendar onto which the privacy calendar cover is mounted.

5 Claims, 4 Drawing Sheets

PRIVACY CALENDAR COVER

FIELD OF THE INVENTION

The present invention generally relates to an office stationary and more particularly, relates to an office accessory of a calendar cover that provides privacy for the user.

BACKGROUND OF THE INVENTION

Blotter desk type calendars are one of the most used stationary items either in a home office or in a regular office environment. The blotter desk type calendars allow a user to not only view the calendar for the month, but also allows the user to view the important events or appointments for the entire month. It is very useful in the daily planning of a person's business. However, one drawback for such blotter desk type calendar is that because the calendar is normally displayed on the person's desk, or workstation, it is in plain view to anyone who happens to walk by or is in the office. The calendar does not provide any privacy to the person's monthly schedule in the event that certain activities marked on the calendar are of a personal or confidential nature. It is therefore desirable to provide a device that can be used to keep a blotter desk type calendar private even though the calendar is placed in plain view of others.

It is therefore object of the present invention to provide a blotter desk type calendar that does not have the drawbacks or shortcomings of the conventional blotter desk calendars.

It is another object of the present invention to provide a privacy calendar cover for use on a standard blotter desk type calendar.

It is a further object of the present invention to provide a privacy calendar cover that only shows the indicia of the month and year when installed on a standard blotter desk type calendar.

SUMMARY OF THE INVENTION

In accordance with the present invention, a privacy calendar cover for use on a standard blotter desk type calendar is provided.

In a preferred embodiment, a privacy calendar cover can be provided which includes a cover body formed of a top portion and a bottom portion joined together by a longitudinally disposed hinge member, the top portion of the cover body is substantially transparent while the bottom portion of the cover body is substantially opaque; and an elongated clip that has U-shaped gap opening in a cross-section therein that is substantially equal to a thickness of a calendar onto which the privacy calendar cover is mounted.

BRIEF DESCRIPTION OF THE DRAWINGS

The invention will now be described, by way of example, with reference to the accompanying drawings, in which.

DETAILED DESCRIPTION OF THE PREFERRED EMBODIMENT

The present invention discloses a privacy calendar cover that can be easily installed on a standard blotter desk type calendar.

The present invention privacy calendar cover is a protective covering for a standard blotter desk calendar. It protects the calendar from damages as well as the users privacy. It can be produced from a plastic material with a selection of different colors. A standard size would measure about 23 inches long and 18½ inches high. It is designed to be placed over the calendar to protect it from tears and coffee stains that can result from being located on the users desk. It includes an elongated clip for installing on a standard calendar along a top edge of the calendar and a cover body that is partially transparent and partially opaque such that the calendar cannot be view by passerby. The user can easily access the calendar at any time by lifting the cover, for instance, to make remarks regarding appointments or to tear out an old month when a new month is starting.

The present invention privacy calendar cover fulfills the need for a protective cover for a desk blotter type calendar. The appealing features of the present invention calendar cover are its convenience, practicality, simplicity, and ease of use. It is also lightweight, durable and inexpensive. It can be provided in a wide variety of sizes and colors and can also be produced with decorative designs and trim. The privacy calendar cover serves to prevent the calendar from being damaged when the consumer uses the desk. He would be able to write, set down a coffee cup, etc. without leaving stains or rips on the calendar. The opaque cover also prevents the calendar from being viewed by anyone except the user. These features appeal to homeowners and office workers.

Figure 1:
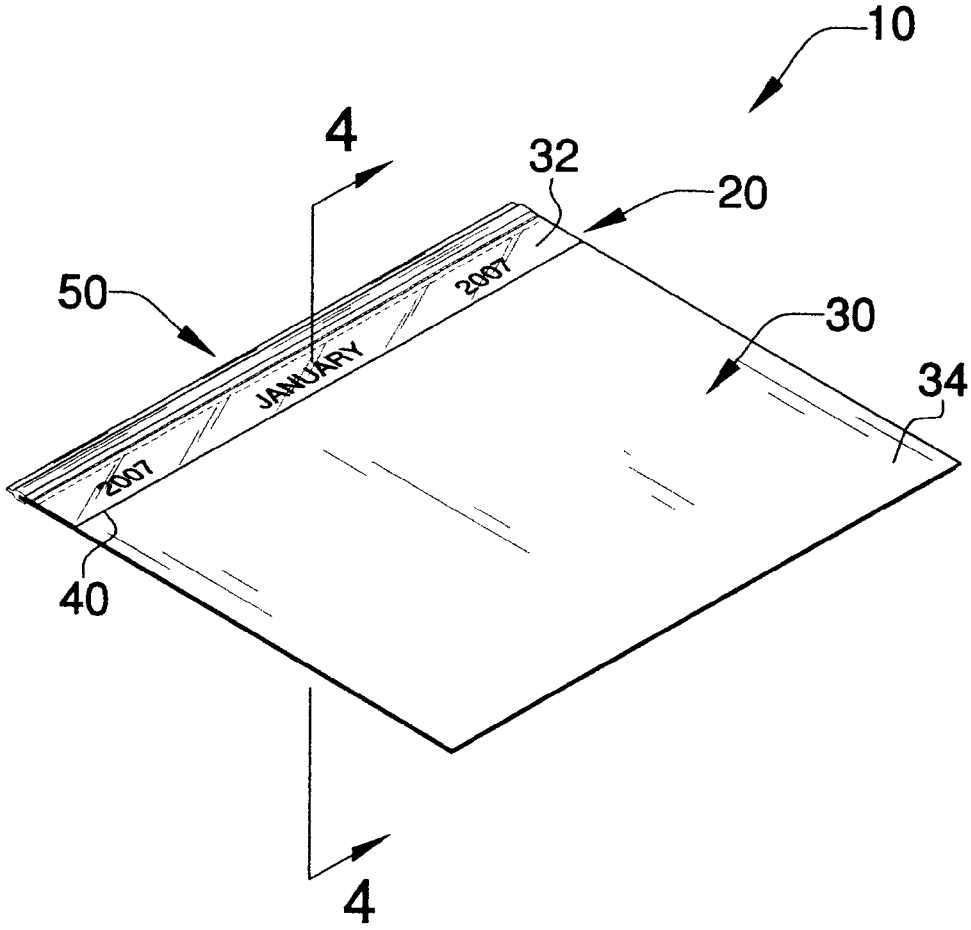
FIG. 1 is a perspective view of the present invention privacy calendar cover as installed on a calendar.
Figure 2:
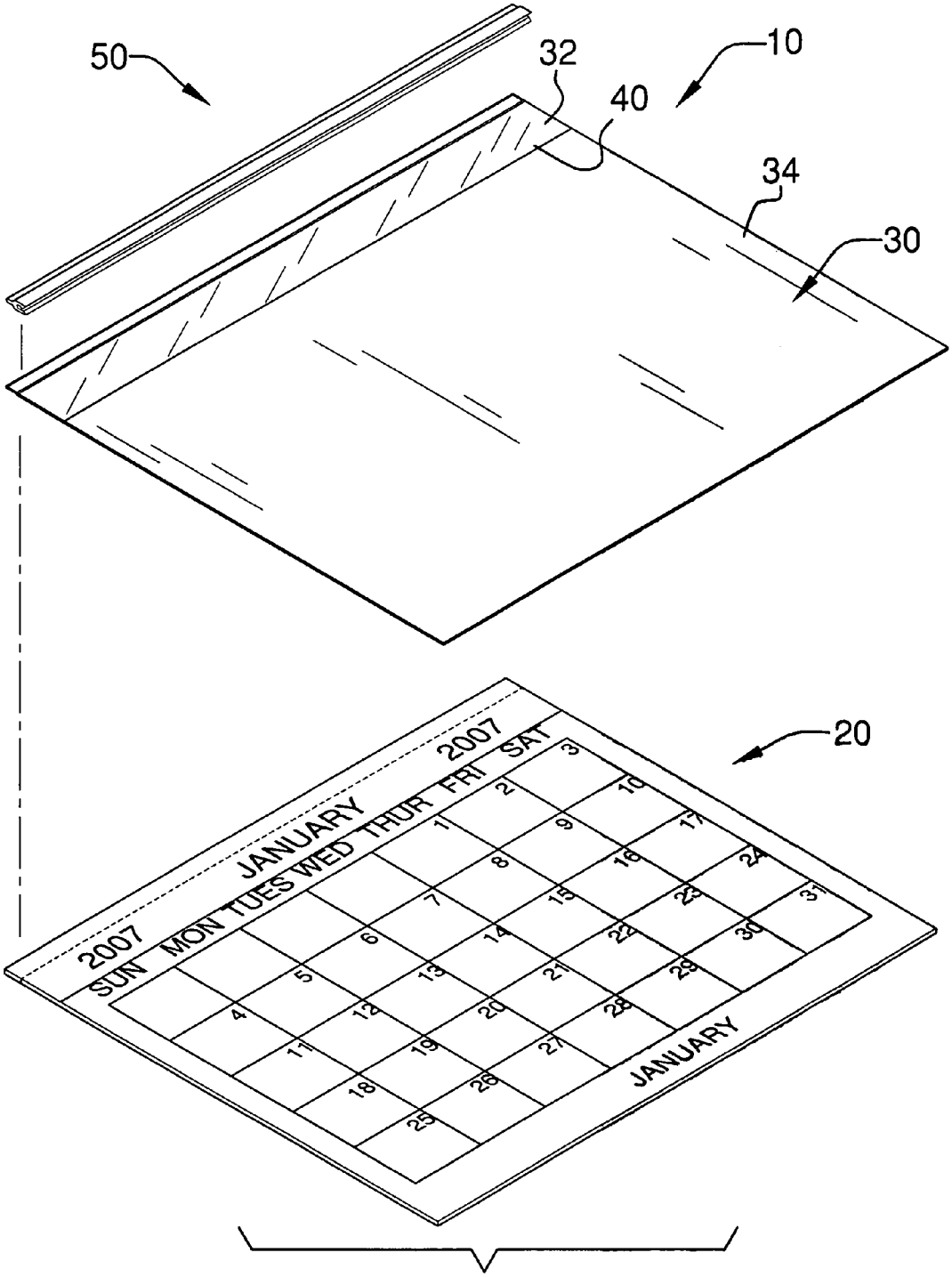
FIG. 2 is a perspective view illustrating the present invention privacy calendar cover positioned on top of a standard blotter desk type calendar.

Referring initially to FIG. 1, wherein a perspective view of a present invention privacy calendar cover 10 is mounted on a calendar 20. Also shown in FIGS. 2, 3 and 4, the present invention privacy calendar cover 10 is constructed of a cover body 30 which is formed of a top portion 32 and a bottom portion 34 joined together by a longitudinally disposed hinge member 40. The top portion 32 and the bottom portion 34 of the cover body 30 are fabricated of a plastic material to a suitable thickness of at least 0.005 inch. The top portion 32 is more suitably fabricated of a plastic material that is substantially transparent such that the indicia for the month and year, see FIG. 1, would show through the top portion 32. The bottom portion 34 of the cover body 30 is preferably fabricated of a plastic material that is substantially opaque such that any remarks or entry on the calendar can be concealed from plain view to any passerby, or to any person who is not authorized to view the calendar. Further shown in FIGS. 1-4, is an elongated clip 50 that is used to install or mount the cover body 30 onto the calendar 20. The elongated clip 50 is installed longitudinally on the calendar 20 as shown in the FIGS. 1-4.

Figure 3:
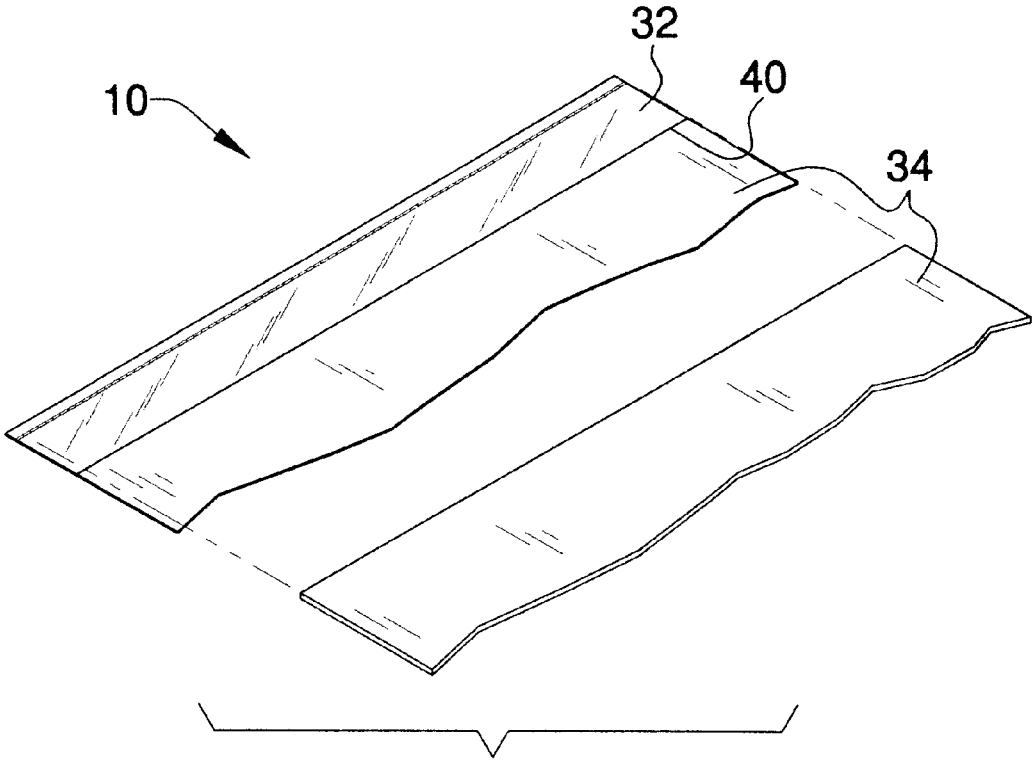
FIG. 3 is a partial, exploded view of the present invention privacy calendar cover.
Figure 4:
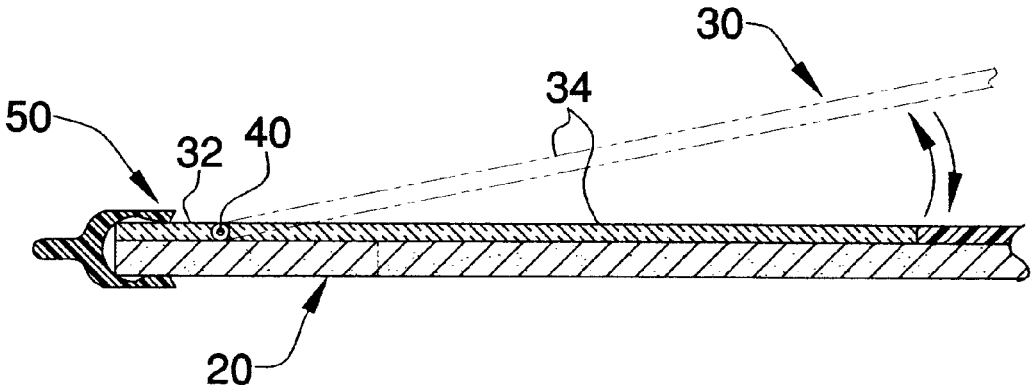
FIG. 4 is a partial, cross-sectional view of the present invention privacy calendar cover as installed on a calendar.

An enlarged view of the clip 50 is shown in FIG. 4 in a cross-sectional view. The elongated clip 50 has a U-shaped cross-section with an opening having a thickness that is substantially equal to a thickness of the calendar 20 such that the clip can hold the cover body 30 and the calendar 20 tightly in place. The hinge member 40 can be suitably fabricated in a hard plastic bead that allows the bottom portion 34 to pivot against the hinge member 40 when it is necessary to lift the bottom portion 34 to access the calendar. It should be noted that FIG. 3 illustrates only the cover body 30 without the elongated clip 50 or the calendar 20.

Figure 5:
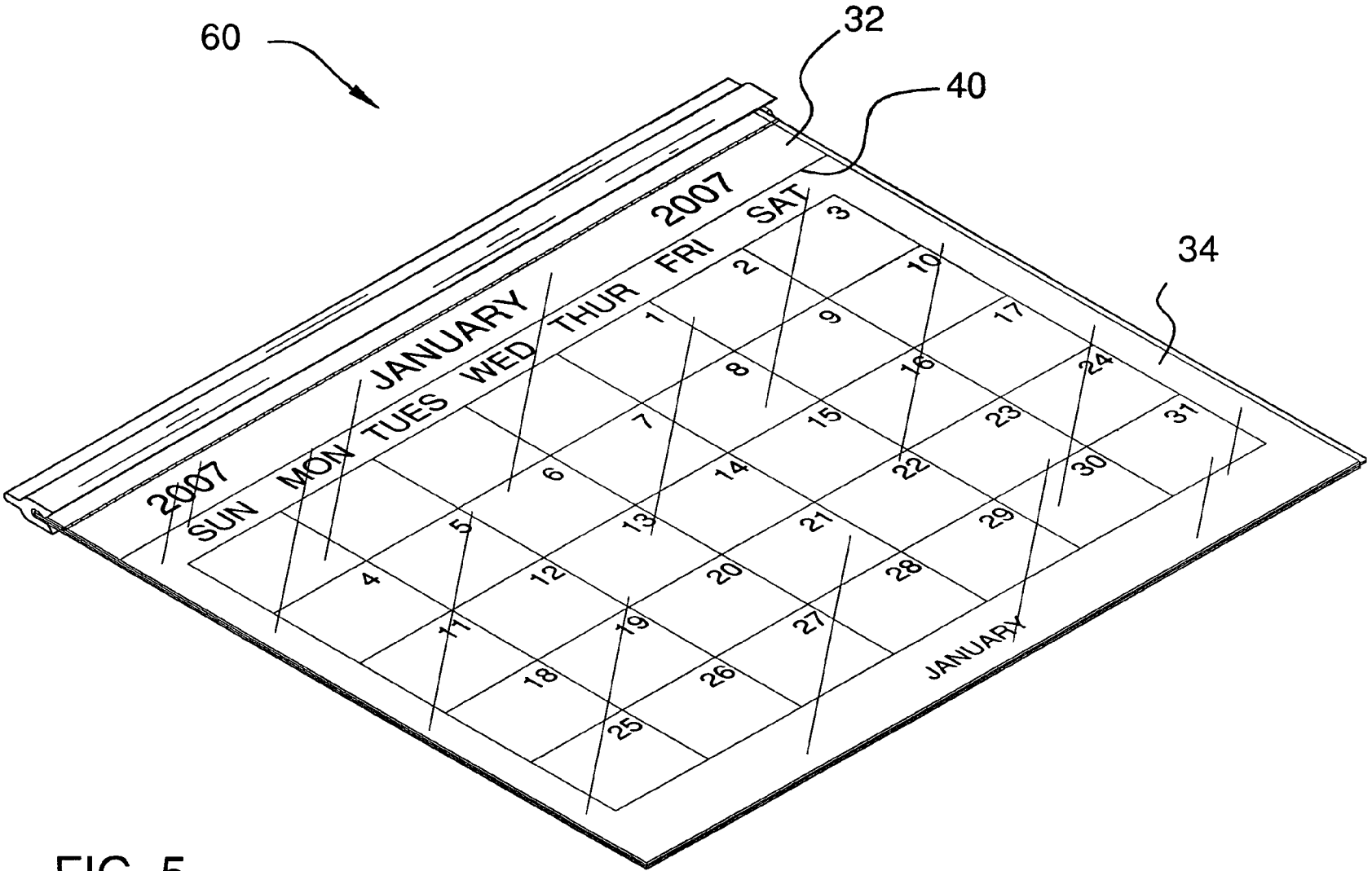
FIG. 5 is another embodiment of the present invention privacy calendar cover wherein the bottom portion is also clear.

An alternate embodiment 60 of the present invention calendar cover is shown in FIG. 5 wherein both the top portion 32 and the bottom portion 34 are fabricated of a plastic material that is substantially transparent. This embodiment does not provide the privacy function as the preferred embodiment cover 10 shown in FIGS. 1-4.

The present invention privacy calendar cover has therefore been amply described in the above descriptions and in the appended drawings of FIGS. 1-5.

While the preferred embodiments of the invention have been described above, it will be recognized and understood that various modifications can be made in the invention and the appended claims are intended to cover all such modifications which may fall within the spirit and scope of the invention.

What is claimed is:

1. A privacy calendar cover comprising:

a cover body formed of a top portion and a bottom portion joined together by a longitudinally disposed hinge member therebetween, said top portion of the cover body being substantially transparent and said bottom portion of the cover body is substantially opaque; and an elongated clip has a U-shaped cross-section with an opening that is substantially equal to a total thickness of a calendar onto which the cover body is mounted, said elongated clip receiving and holding said cover body and said calendar tightly in place while allowing said bottom portion of said cover to pivot about said hinge member to conceal or expose a corresponding portion of said calendar.

2. The privacy calendar cover according to claim 1, wherein said cover body is formed of a plastic material.

3. The privacy calendar cover according to claim 1, wherein said hinge member is formed of a plastic bead.

4. The privacy calendar cover according to claim 1, wherein said elongated clip is formed of a rigid plastic.

5. The privacy calendar cover according to claim 1, wherein said calendar includes indicia of the month and year thereon, and wherein said top portion having a width that is sufficient to show the indicia of the month and year.

* * * * *